US006747222B1

(12) United States Patent
Wong et al.

(10) Patent No.: US 6,747,222 B1
(45) Date of Patent: Jun. 8, 2004

(54) FEATURE FORMATION IN A NONPHOTOIMAGABLE MATERIAL AND SWITCH INCORPORATING SAME

(75) Inventors: Marvin Glenn Wong, Woodland Park, CO (US); You Kondoh, Yamato (JP); John Ralph Lindsey, Tokyo (JP)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/357,794

(22) Filed: Feb. 4, 2003

(51) Int. Cl.[7] ..... H01H 29/00
(52) U.S. Cl. ..... 200/182; 200/191
(58) Field of Search ..... 200/61.47, 220, 200/187–192, 199, 201, 214, 221–229, 235, 236, 182, 197; 427/79; 29/622, 592, 887

(56) References Cited

U.S. PATENT DOCUMENTS

| | | | |
|---|---|---|---|
| 2,312,672 | A | 3/1943 | Pollard, Jr. |
| 2,564,081 | A | 8/1951 | Schilling |
| 3,430,020 | A | 2/1969 | Von Tomkswitsch et al. |

(List continued on next page.)

FOREIGN PATENT DOCUMENTS

| | | | |
|---|---|---|---|
| EP | 593836 | A1 | 4/1994 |
| FR | 2418539 | | 9/1979 |
| FR | 2458138 | | 12/1980 |
| FR | 2667396 | | 4/1992 |
| JP | 36-18575 | | 10/1961 |
| JP | 47-21645 | | 10/1972 |
| JP | 62-276838 | | 12/1987 |
| JP | 63-294317 | | 12/1988 |
| JP | 9161640 | A | 6/1997 |
| JP | 8-125487 | | 5/1998 |
| WO | WO99/46624 | | 12/1999 |

OTHER PUBLICATIONS

Jonathan Simon, "A Liquid–Filled Microrelay With A Moving Mercury Microdrop" (Sep. 1997) Journal of Microelectromechinical Systems, vol. 6, No. 3, pp 208–216.
Marvin Glenn Wong, "A Plexoelectrically Actuated Liquid Metal Switch" May 2, 2002. 12, pages of specification, 5 pages of claims, 1 page of abstract, and 10 sheets of drawings (Fig. 1–10).
Joanwon Kim et al., "A Micromechanical Switch With Electrostatically Driven Liquid–Metal Droplet", Sensors and Actuators, A: Physical. v 9799, Apr. 1, 2002, 4 pages.
Marvin Glenn Wong, "Laser Cut Channel Plate For A Switch", Patent application, 11 pages of specification, 5 pages of claims, 1 page of abstract, and 4 sheets of formal drawings (Fig. 1–10).
TDB–Acc–No: NB8406827, "Integral Power Resistors For Aluminum Substrate", IBM Technical Disclosure Bulletin, Jun. 1984, US, vol. 27, Issue No. 18, p. 827.
Bhadwar, Homi C., et al. "Ceramic Multilayer Package Fabrication." Electronic Materials Handbook, Nov. 1989, pp 460–469, vol. 1 Packaging, Sec. 4: Packages.
Marvin Glenn Wong, U.S. application Ser. No. 10/137,691, "A Piezoelectrically Actuated Liquid Metal Switch", May 2, 2002, patent application (pending), 12 pages of specification, 5 pages of claims, 1 page of abstract, and 10 sheets of drawings (Figs. 1–10).

*Primary Examiner*—Michael Friedhofer
*Assistant Examiner*—Lisa Klaus

(57) ABSTRACT

A first resist is deposited on at least a portion of a substrate (or existing feature on the substrate) that will underlie a feature in a nonphotoimagable material that is to be deposited on the substrate. Thereafter, the nonphotoimagable material is deposited so that it overlaps at least a portion of the first resist. A second resist is then deposited on at least a portion of the nonphotoimagable material, and a feature is patterned on the second resist. Subsequently, the part is sandblasted until the first resist is exposed, and the first and second resists are then removed. In one embodiment, the nonphotoimagable material is deposited on a channel plate and used to seal at least a switching fluid between the channel plate and another substrate.

9 Claims, 10 Drawing Sheets

U.S. PATENT DOCUMENTS 3,529,268 A 9/1970 Reuterberg
3,600,537 A 8/1971 Twyford
3,639,165 A 2/1972 Rairden, III
3,657,647 A 4/1972 Beusman et al.
4,103,135 A 7/1978 Gomez et al.
4,200,779 A 4/1980 Zakurdaev et al.
4,238,748 A 12/1980 Goullin et al.
4,245,886 A 1/1981 Kolodzey et al.
4,336,570 A 6/1982 Brower
4,419,650 A 12/1983 John
4,434,337 A 2/1984 Becker
4,475,033 A 10/1984 Willemsen et al.
4,505,539 A 3/1985 Auracher et al.
4,582,391 A 4/1986 Legrand
4,628,161 A 12/1986 Thackrey
4,652,710 A 3/1987 Karnowsky et al.
4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A * 3/1999 Nellissen et al. ..... 29/25.35
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 * 3/2001 Jiang ..... 427/333
6,212,308 B1 4/2001 Donald
6,225,133 B1 * 5/2001 Yamamichi et al. ..... 438/3
6,278,541 B1 8/2001 Baker
6,304,450 B1 10/2001 Dibene, II et al.
6,320,994 B1 11/2001 Donald et al.
6,323,447 B1 11/2001 Kondoh
6,351,579 B1 2/2002 Early et al.
6,356,679 B1 3/2002 Kapany
6,373,356 B1 4/2002 Gutierrez
6,396,371 B2 5/2002 Streeter et al.
6,398,012 B1 6/2002 Volpe
6,408,112 B1 6/2002 Bartels
6,446,317 B1 * 9/2002 Figueroa et al. ..... 29/25.42
6,453,086 B1 9/2002 Tarazona
6,470,106 B2 10/2002 McClelland et al.
6,487,333 B2 11/2002 Fouquet
6,501,354 B1 12/2002 Gutierrez et al.
6,512,322 B1 1/2003 Fong
6,515,404 B1 2/2003 Wong
6,516,504 B2 * 2/2003 Schaper ..... 29/25.42
6,559,420 B1 * 5/2003 Zarew ..... 219/209
6,633,213 B1 10/2003 Dove
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

* cited by examiner

FEATURE FORMATION IN A NONPHOTOIMAGABLE MATERIAL AND SWITCH INCORPORATING SAME

BACKGROUND

It is sometimes necessary to form a feature or features in a nonphotoimagable material 102 deposited on a substrate 100 (see FIGS. 1 & 2). One way to do this is by first depositing the nonphotoimagable material on the substrate, and then mechanically removing portions of the nonphotoimagable material (e.g., by means of sandblasting) to define the feature 104 or features therein. However, removing portions of a nonphotoimagable material in this way almost always results in removal of some of the substrate. For some applications, this is acceptable. For instance, if a channel 200 needs to be formed in the substrate, and it is desired that the nonphotoimagable material be registered to the edges of the channel, then it may be acceptable to deposit the nonphotoimagable material on the substrate and then sandblast through both the nonphotoimagable material and the substrate until the channel is formed in the substrate. In other applications, the removal of substrate material is not necessary, or even undesirable. In these applications, the above-described method for removing portions of a nonphotoimagable material from a substrate can be problematic.

The above-described method can also be problematic due to adverse reactions between the removal means (e.g., a sandblasting machine) and the substrate. For instance, if the substrate is metallic, sandblasting its surface might result in electrostatic discharge which tends to blacken the substrate or nonphotoimagable material or, in a worse case scenario, even melt or vaporize the nonphotoimagable material.

The above-described method can also be problematic when a feature to be formed in a nonphotoimagable material lies above an existing substrate feature. For example, if a feature to be formed in a nonphotoimagable material lies above 1) a thin layer of material that has already been deposited on a substrate, 2) a layer of carefully controlled thickness that has already been deposited on the substrate, or 3) a component or other feature that has already been formed in, or deposited on, the substrate, then any blasting of (or "blast through") such a feature would likely be undesirable.

Finally, even when it might be acceptable to deposit a nonphotoimagable material on a substrate and then remove portions of the nonphotoimagable material along with portions of the substrate, there might be later manufacturing steps which make the timing of such deposition and feature formation impractical. For example, consider a need to thermally or chemically treat (e.g., anneal or etch) a substrate channel that is formed after the nonphotoimagable material is deposited on the substrate. If the nonphotoimagable material cannot withstand the thermal or chemical treatment, then depositing it on the substrate prior to formation and treatment of the substrate channel would be undesirable.

SUMMARY OF THE INVENTION

One aspect of the invention is embodied in a method for forming a feature in a nonphotoimagable material deposited on a substrate. The method comprises depositing a first resist on at least a portion of the substrate that will underlie the feature in the nonphotoimagable material. The nonphotoimagable material is then deposited so that it overlaps at least a portion of the first resist. Thereafter, a second resist is deposited on at least a portion of the nonphotoimagable material, and the feature is patterned on the second resist. The part is then sandblasted until the first resist is exposed. After sandblasting, the first and second resists are removed.

Another aspect of the Invention is embodied in a method for protecting an existing feature on a substrate while forming a new feature in a nonphotoimagable material deposited on the substrate. The method comprises depositing a first resist on at least a portion of the existing feature that will underlie the new feature. The nonphotoimagable material is then deposited so that it overlaps at least a portion of the first resist. Thereafter, a second resist is deposited on at least a portion of the nonphotoimagable material, and the new feature is patterned on the second resist. The part is then sandblasted until the first resist is exposed. After sandblasting, the first and second resists are removed.

Yet another aspect of the invention is embodied in a switch. The switch is produced by forming at least one channel in a channel plate then depositing a first resist on at least a portion of a channel that will underlie a feature that is to be formed in a nonphotoimagable material. The nonphotoimagable material is then deposited so that it overlaps at least a portion of the first resist. Thereafter, a second resist is deposited on at least a portion of the nonphotoimagable material, and the feature is patterned on the second resist. The channel plate is then sandblasted until the first resist is exposed. After sandblasting, the first and second resists are removed. Finally, the at least one channel formed in the channel plate is aligned with at least one feature on a substrate, and at least a switching fluid is sealed between the channel plate and the substrate by means of the nonphotoimagable material.

Other embodiments of the invention are also disclosed.

BRIEF DESCRIPTION OF THE DRAWINGS

Illustrative embodiments of the invention are illustrated in the drawings, in which.

DETAILED DESCRIPTION OF THE INVENTION

Figure 1:
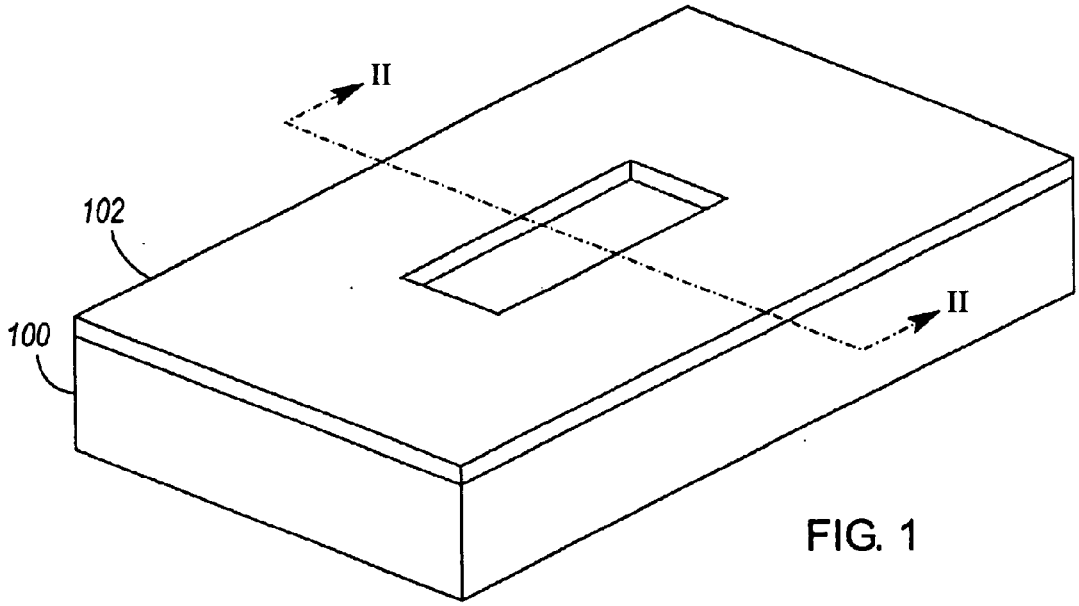
FIG. 1 illustrates a substrate with nonphotoimagable material deposited thereon.
Figure 2:
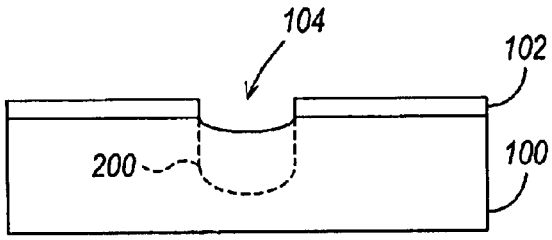
FIG. 2 illustrates a cross-section of the substrate and nonphotoimagable material shown in FIG. 1.
Figure 3:
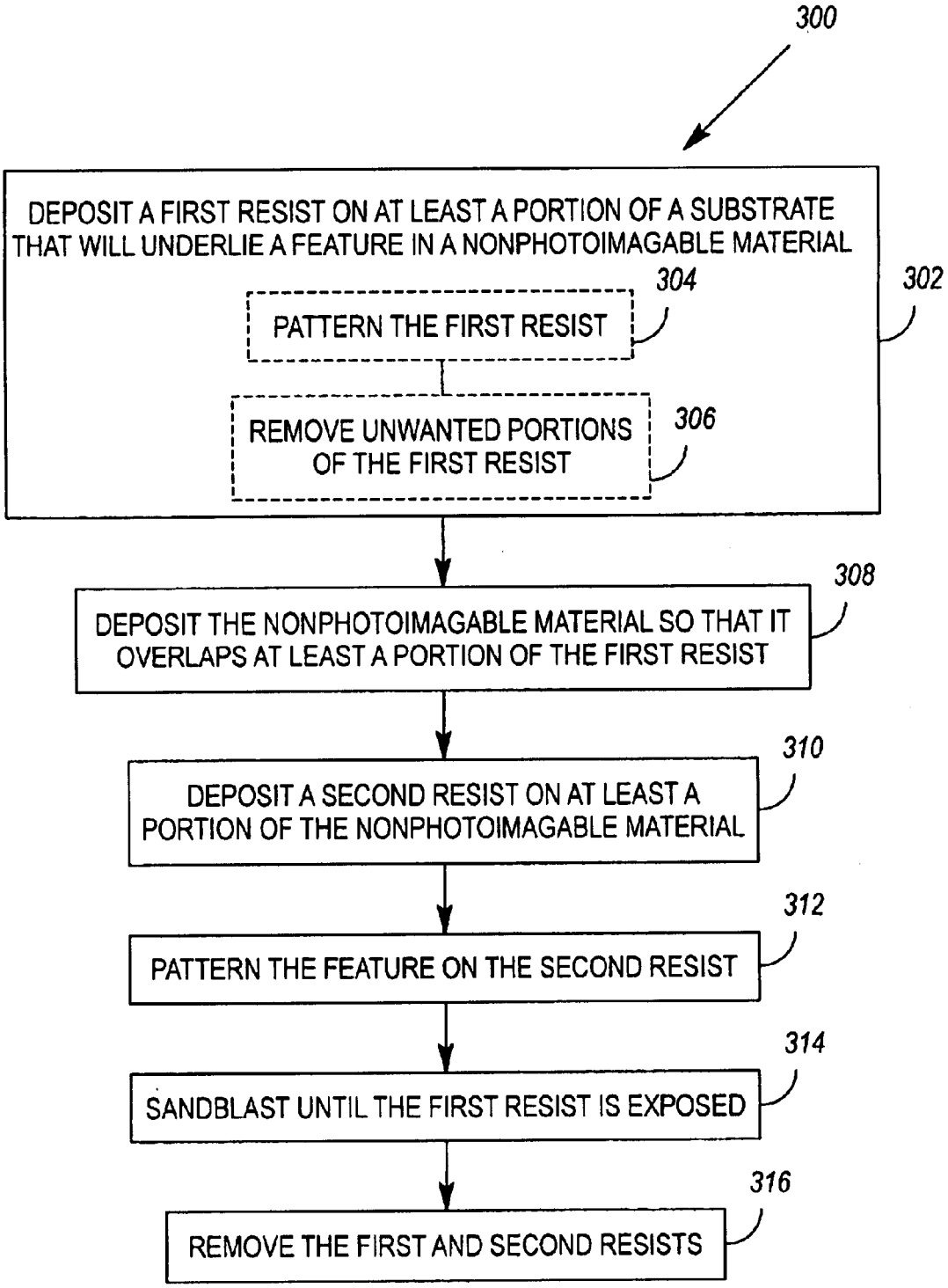
FIG. 3 illustrates a method for forming a feature in a nonphotoimagable material deposited on a substrate.
Figure 4:
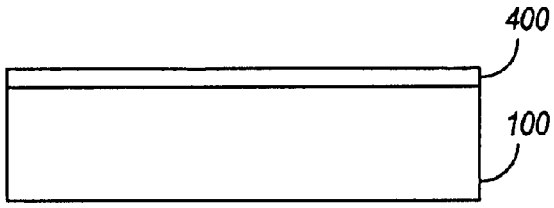
FIGS. 4 & 5 illustrate the deposition of a first resist on a cross-section of substrate.
Figure 5:
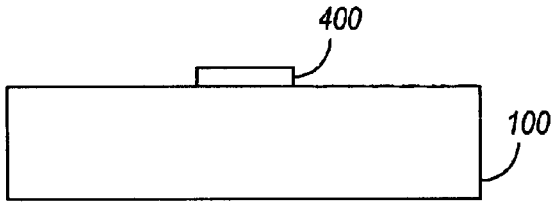

FIG. 3 illustrates a method 300 for forming a feature in a nonphotoimagable material deposited on a substrate. The method 300 commences with the deposition 302 of a first resist 400 on at least a portion of the substrate 100 that will underlie the feature in the nonphotoimagable material. The resist 400 may be deposited in a variety of ways. One way to deposit the resist 400 is to deposit the resist 400 on an entire surface of the substrate 100 (FIG. 4), pattern 304 the resist 400, and then remove 306 unwanted portions of the resist 400 by developing or etching them away (FIG. 5). Depending on how the resist 400 is patterned, a separate step may not be needed to remove the unwanted portions of the resist 400 (e.g., depending on the process used to pattern the resist 400, patterning the resist 400 may cause the unwanted portions of the resist 400 to disintegrate or vaporize).

Figure 6:
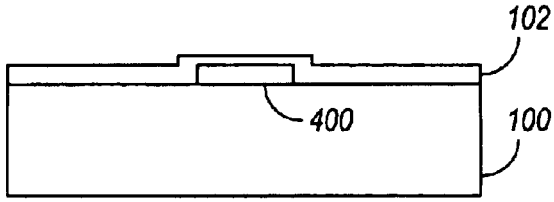
FIG. 6 illustrates the deposition of a nonphotoimagable material on the FIG. 5 cross-section.

The nonphotoimagable material 102 is then deposited 308 so that it overlaps at least a portion of the first resist 400 (FIG. 6). By way of example, the nonphotoimagable material 102 may be deposited by means of spin or spray coating.

Figure 7:
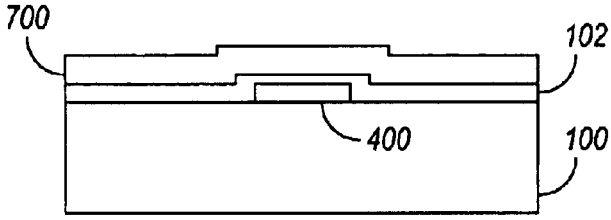
FIG. 7 illustrates the deposition of a second resist on the FIG. 6 cross-section.
Figure 8:
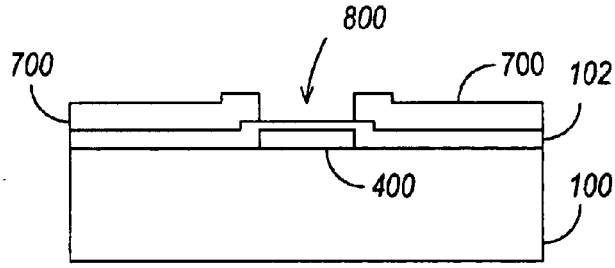
FIG. 8 illustrates the patterning of a feature in the second resist shown in the FIG. 7 cross-section.

Next, a second resist 700 is deposited 310 on at least a portion of the nonphotoimagable material 102 (FIG. 7), and the feature 800 to be formed in the nonphotoimagable material 102 is patterned 312 on the second resist 700 (FIG. 8). By way of example, FIG. 8 shows the feature 800 to be removed from the resist 700. However, depending on the process used to pattern the feature 800, as well as the composition of the resist 700, the feature 800 may or may not be removed from the resist 700 during patterning. If the feature 800 is not removed from the resist 700, it may be separately removed, or it may be removed during the step described in the next paragraph.

Figure 9:
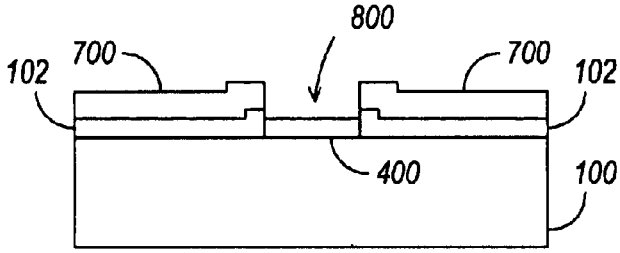
FIG. 9 illustrates the formation of a feature in the nonphotoimagable material shown in the FIG. 8 cross-section.

After the feature to be formed in the nonphotoimagable material 102 is patterned in the second resist 700, the part shown in FIG. 8 is sandblasted 314 until the resist 400 is exposed (FIG. 9). "Sandblasting" is defined herein to comprise any process in which particles are ejected towards a part. As a result, the particles need not be "sand". The part should be sandblasted long enough to adequately define the feature in the nonphotoimagable material 102, yet not so long as to "blast through" the resist 400. Variables that may be adjusted to prevent "blast through" may include: blast particle size, blast particle composition, blast force, residence time (i.e., the time that a portion of the part is sandblasted), and scan speed (i.e., how quickly a moving blast nozzle passes over the part, or how quickly a moving part passes under a blast nozzle). In some cases, the likelihood of "blast through" may be mitigated by depositing the first resist 400 at a greater thickness than the nonphotoimagable material 102.

Figure 10:
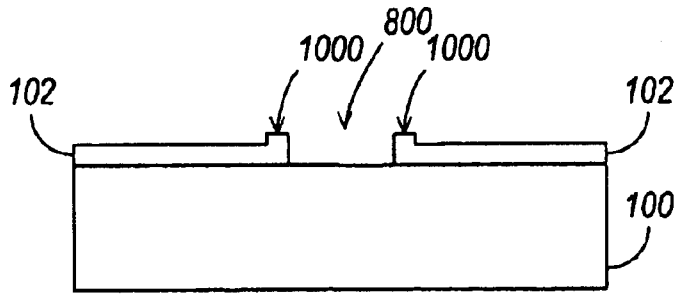
FIG. 10 illustrates removal of the first and second resists shown in the FIG. 9 cross-section.

Following sandblasting, the first and second resists 400, 700 are removed 316 (FIG. 10). By way of example, the resists 400, 700 may be removed using an etching or developing process. Depending on the nature of the nonphotoimagable material 102, and the process or processes used to remove the resists 400, 700, it may be necessary to cure the nonphotoimagable material 102 prior to removing one or both of the resists 400, 700. The curing may be achieved by exposing the nonphotoimagable material 102 to ambient conditions for a period of time, by heating the nonphotoimagable material 102, by submersing the nonphotoimagable material 102 in an appropriate solution, or by other means. If necessary, the nonphotoimagable material 102 may also be cured (or cured further) after the resists 400, 700 are removed.

It should be noted that the layer of nonphotoimagable material 102 shown in FIG. 10 comprises a pair of "bumps" 1000. The extent of these bumps can be mitigated, or the bumps can even be eliminated, by 1) minimizing the thickness of the first resist 400 with respect to the thickness of the nonphotoimagable material 102, 2) flattening, abrading, and/or smoothing the nonphotoimagable material 102, either while it is being deposited (or after it is deposited), or 3) depositing the first resist 400 at a width that is somewhat less than the width of the feature 800 to be formed in the nonphotoimagable material 102. Depending on the composition of the nonphotoimagable material 102, the bumps 1000 could also be removed following removal of the resists 400, 700 (e.g., by means of grinding and polishing or chemical mechanical planarization). The bumps 1000 may also be crushed or squashed if, for example, the nonphotoimagable material 102 is an adhesive or gasket material with some degree of resiliency.

The first and second resists 400, 700 may be variously chosen, depending on the application for which they are used. For example, and depending on the composition of the substrate 100 and/or nonphotoimagable material 102, the resists 400, 700 may be positive or negative, organic or inorganic. The compositions of the resists 400, 700 may be the same or different.

Figure 11:
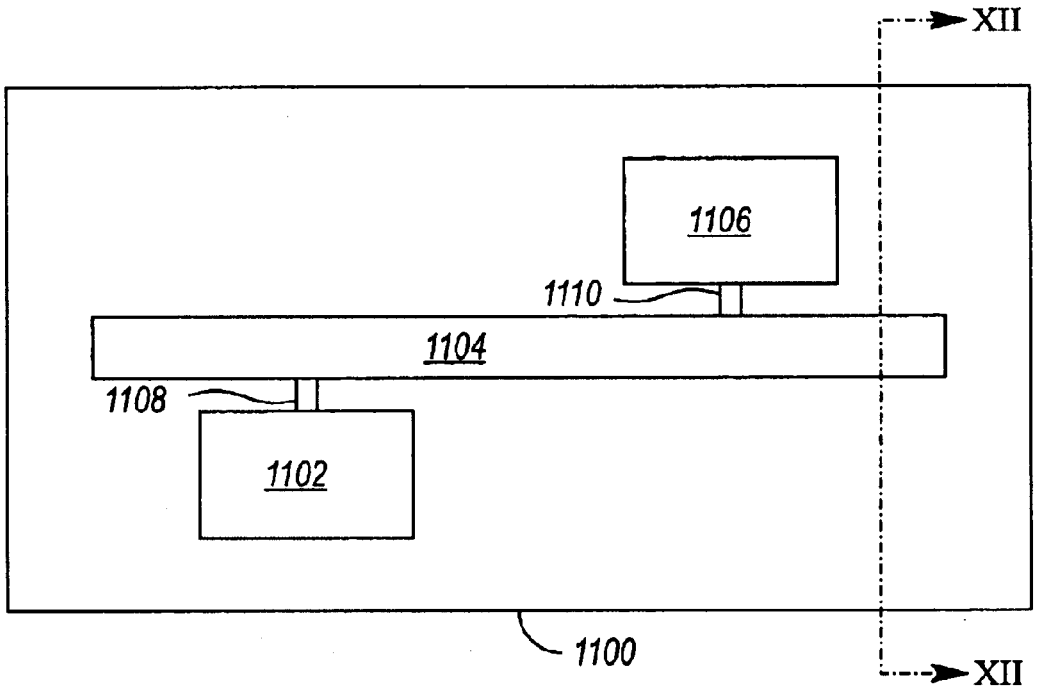
FIG. 11 illustrates a plan view of a substrate with channels formed therein (i.e., a channel plate)
Figure 12:
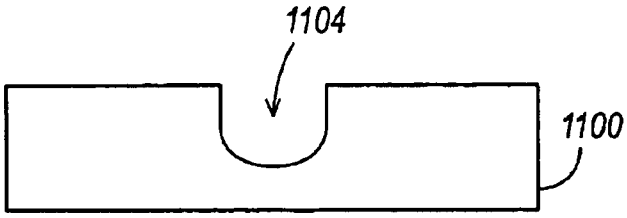
FIG. 12 illustrates an elevation of the FIG. 11 channel plate.

By way of example, the composition of the substrate 100 could be glass, ceramic, metal or polymer. Although the surface of the substrate 100 illustrated in FIGS. 4–10 is shown to be flat, it need not be. FIG. 11 therefore illustrates a substrate 1100 having a number of channels 1102, 1104, 1106, 1108, 1110 formed therein. For the purpose of this description, "channel" is defined to be any sort of groove, trough, pit or other feature that creates a recess extending below the uppermost surface of a channel plate. A cross-section of one of the channels 1104 shown in FIG. 11 is illustrated in FIG. 12. The remaining channels 1102, 1106–1110 may have the same cross-section, or have cross-sections of varying shapes, widths, and/or depths. When the method 300 set forth in FIG. 3 is applied to the substrate 1100 shown in FIG. 11, the first resist may be deposited such that it fills a portion of, all of, or more than the extent of a channel 1104 formed in the substrate.

Figure 13:
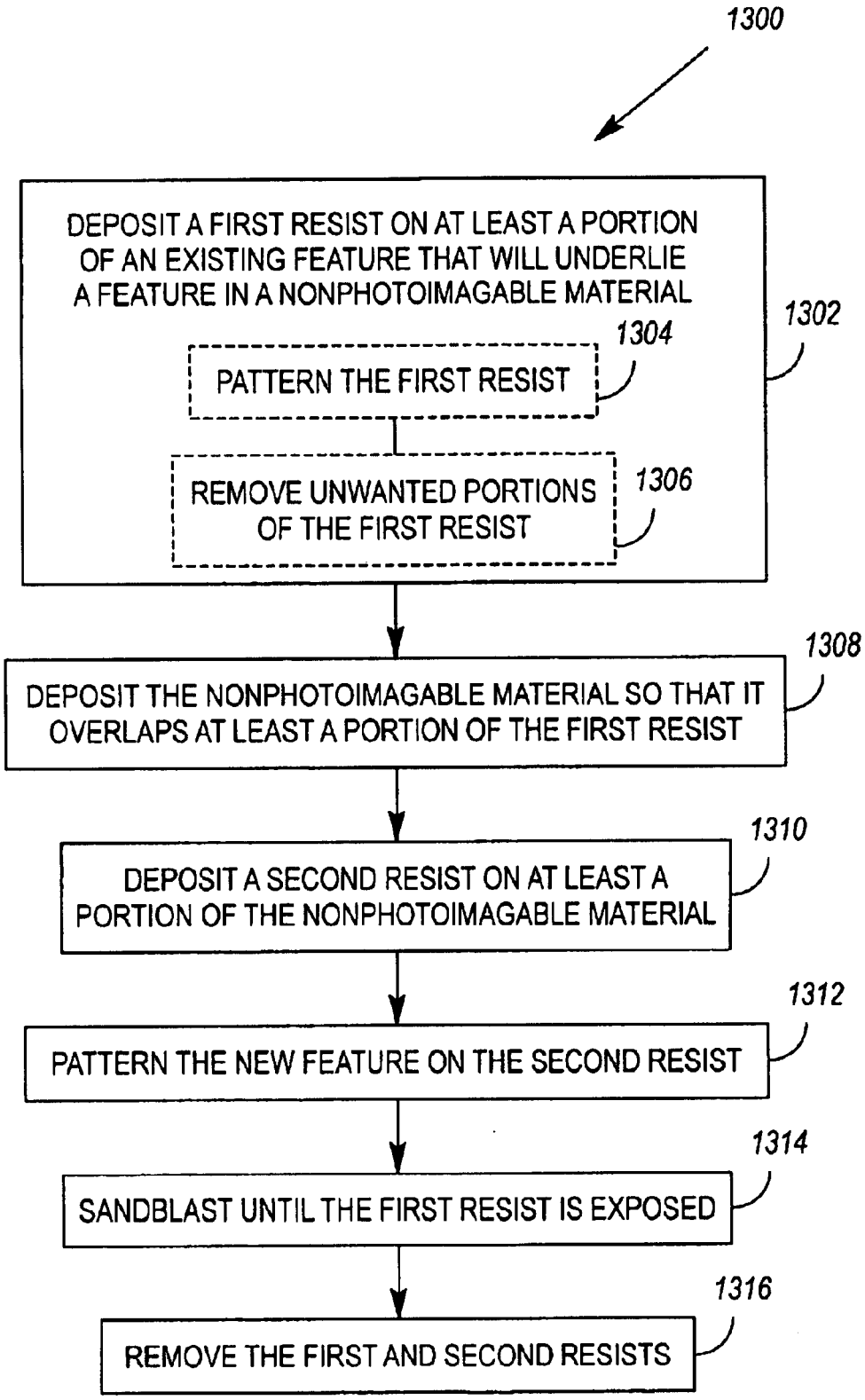
FIG. 13 illustrates a method for protecting an existing feature on a substrate while forming a new feature in a nonphotoimagable material deposited on the substrate.

Building on the method disclosed in FIG. 3, FIG. 13 illustrates a method 1300 for protecting an existing feature on a substrate while forming a new feature in a nonphotoimagable material deposited on the substrate. The existing feature may assume a variety of forms. In the following description, the existing feature is a channel 1104 having a layer of metal 1406 deposited thereon. See FIGS. 14 & 15.

Figure 16:
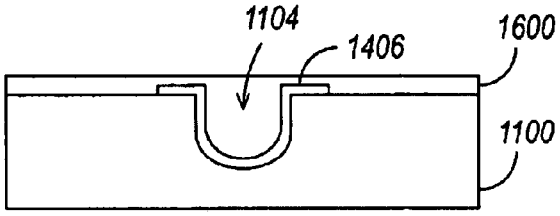
FIGS. 16 & 17 illustrate the deposition of a first resist on the FIG. 15 cross-section.
Figure 17:
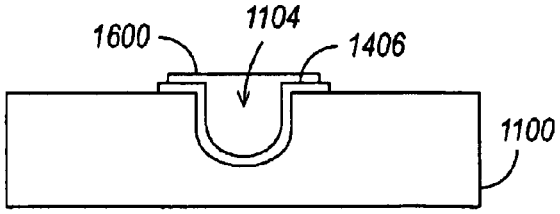

The method 1300 commences with the deposition 1302 of a first resist 1600 on at least a portion of the existing feature 1406 that will underlie the feature that is to be formed in the nonphotoimagable material. The resist 1600 may be deposited in a variety of ways. One way to deposit the resist 1600 is to deposit the resist 1600 on an entire surface of the substrate 1100 (FIG. 16), pattern 1304 the resist 1600, and then remove 1306 unwanted portions of the resist 1600 by developing or etching them away (FIG. 17). Depending on how the resist 1600 is patterned, a separate step may not be needed to remove the unwanted portions of the resist 1600 (e.g., depending on the process used to pattern the resist 1600, patterning the resist 1600 may cause the unwanted portions of the resist 1600 to disintegrate or vaporize).

Although FIG. 17 shows the resist 1600 as filling the channel 1104 and having a level upper surface, the resist 1600 could alternately have a concave or convex upper surface. Furthermore, the resist 1600 need not completely fill the channel 1104, so long as the resist 1600 covers those portions of the channel 1104 and feature 1406 that need to be protected during formation of a feature in a nonphotoimagable material that is to be deposited over the channel 1104.and feature 1406. Additionally, although the resist 1600 is shown in FIG. 17 to have a width that is less than the width of the metal layer 1406, the resist 1600 could alternately extend beyond one or more edges of the layer 1406. However, by depositing the resist 1600 as shown in FIG. 17, a nonphotoimagable material 1800 that is deposited next is allowed to overlap the metal layer 1406. This can sometimes be advantageous, as discussed in the context of a switch later in this description.

Figure 18:
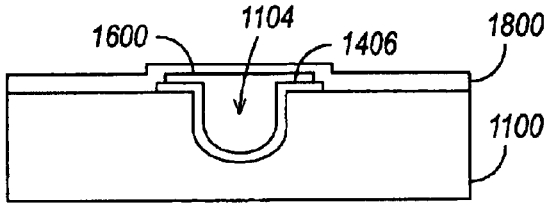
FIG. 18 illustrates the deposition of a nonphotoimagable material on the FIG. 17 cross-section.

After deposition of the resist 1600, the nonphotoimagable material 1800 is deposited 1308 so that it overlaps at least a portion of the resist 1600 (FIG. 18). By way of example, the nonphotoimagable material 1800 may be deposited by means of spin or spray coating.

Figure 19:
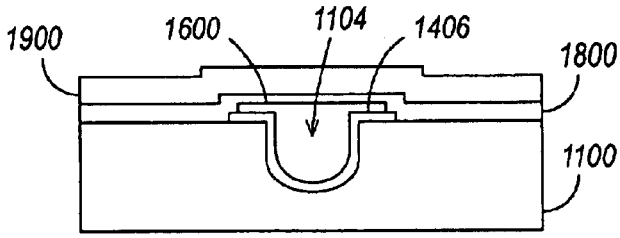
FIG. 19 illustrates the deposition of a second resist on the FIG. 18 cross-section.
Figure 20:
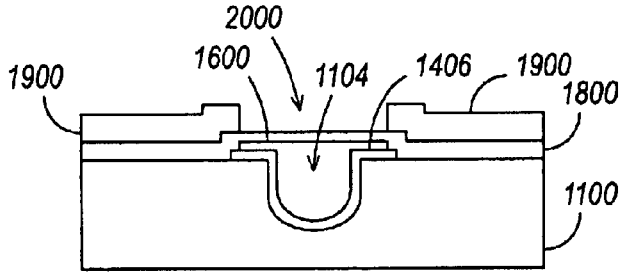
FIG. 20 illustrates the patterning of a feature in the second resist shown in the FIG. 19 cross-section.

Next, a second resist 1900 is deposited 1310 on at least a portion of the nonphotoimagable material 1800 (FIG. 19), and the feature 2000 to be formed in the nonphotoimagable material 1800 Is patterned 1312 on the second resist 1900 (FIG. 20). By way of example, FIG. 20 shows the feature 2000 to be removed from the resist 1900. However, depending on the process used to pattern the feature 2000, as well as the composition of the resist 1900, the feature 2000 may or may not be removed from the resist 1900 during patterning. If the feature 2000 is not removed from the resist 1900, it may be separately removed, or it may be removed during the step described in the next paragraph.

Figure 21:
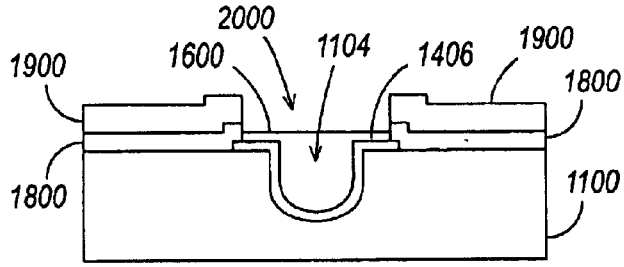
FIG. 21 illustrates the formation of a feature in the nonphotoimagable material shown in the FIG. 20 cross-section.

After the feature to be formed in the nonphotoimagable material 1800 is patterned in the second resist 1900, the part shown in FIG. 20 is sandblasted 1314 until the resist 1600 is exposed (FIG. 21). The part should be sandblasted long enough to adequately define the feature in the nonphotoimagable material 1800, yet not so long as to "blast through" the resist 1600. Variables that may be adjusted to prevent "blast through" have been discussed previously. In some cases, the likelihood of "blast through" may be mitigated by depositing the first resist 1600 at a greater thickness than the nonphotoimagable material 1800.

Figure 22:
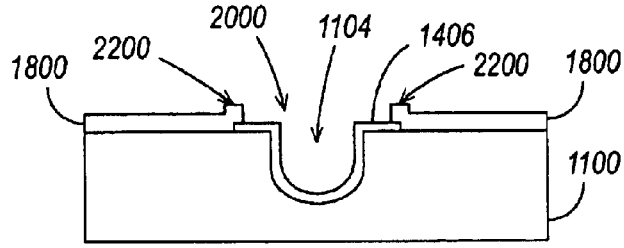
FIG. 22 illustrates removal of the first and second resists shown in the FIG. 21 cross-section.

Following sandblasting, the first and second resists 1600, 1900 are removed 1316 (FIG. 22). By way of example, the resists 1600, 1900 may be removed using an etching or developing process. Depending on the nature of the nonphotoimagable material 1800, and the process or processes used to remove the resists 1600, 1900, it may be necessary to cure the nonphotoimagable material 1800 prior to removing one or both of the resists 1600, 1900. The curing may be achieved by exposing the nonphotoimagable material 1800 to ambient conditions for a period of time, by heating the nonphotoimagable material 1800, by submersing the nonphotoimagable material 1800 in an appropriate solution, or by other means. If necessary, the nonphotoimagable material 1800 may also be cured (or cured further) after the resists 1600, 1900 are removed.

It should be noted that the layer of nonphotoimagable material 1800 shown in FIG. 22 comprises a pair of "bumps" 2200. The extent of these bumps can be mitigated as previously discussed with respect to the bumps 1000 appearing on the layer of nonphotoimagable material 102 shown in FIG. 10.

Figure 23:
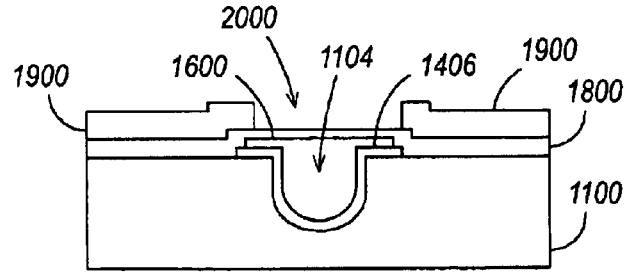
FIGS. 23–25 illustrate a variation on FIGS. 20–22.
Figure 24:
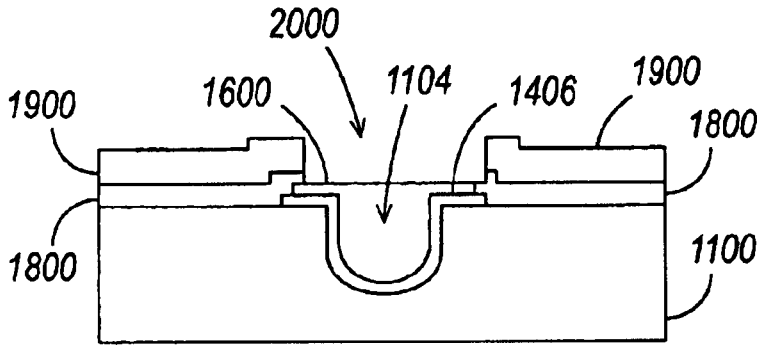
Figure 25:
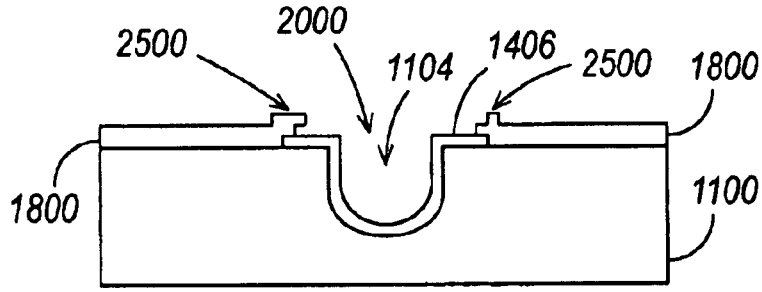
Figure 26:
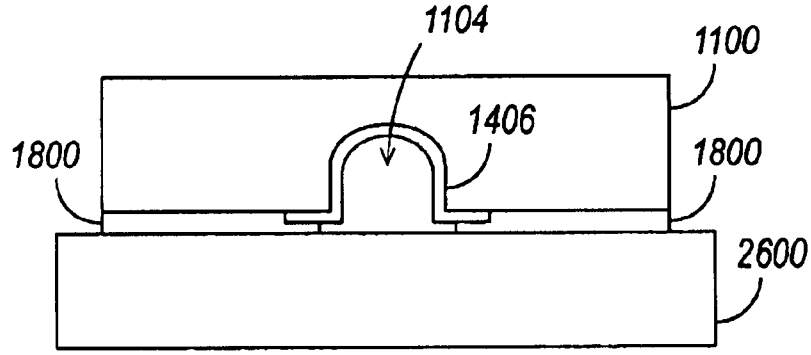
FIG. 26 illustrates mating the part shown in FIG. 22 or FIG. 25 to a substrate.

FIGS. 23–25 illustrate a variation on the sequence of cross-sections shown in FIGS. 20–22. In FIG. 23, note that the feature 2000 patterned in the resist 1900 is shifted to the right, and is thus misaligned. Although a number of misalignments, mis-sizings, and so on can be contemplated, FIG. 23 illustrates one of the more notable variances that can be encountered when the feature 2000 is misaligned and/or mis-sized. This variance becomes more clear with reference to FIG. 24 (in which the feature 2000 is sandblasted into the nonphotoimagable material 1800) and FIG. 25 (in which the resists 1600, 1900 are removed). Referring to FIG. 25, one notes a raised "lip" of nonphotoimagable material on the left of channel 1104. Although steps could be taken to remove this lip, the lip can alternately be crushed or squashed if, for example, the nonphotoimagable material 1800 is an adhesive or gasket material with some degree of resiliency.

As previously described with respect to FIG. 3, the first and second resists 1600, 1900 may be variously chosen, depending on the application for which they are used.

If desired, the part illustrated in FIG. 22 or FIG. 25 may be mated to another part 2600.

Given that fluid-based switch manufacture, including the manufacture of liquid metal micro switches (or LIMMS), is one potential and intended application for the methods illustrated In FIGS. 3 & 13, some exemplary fluid-based switches to which these methods can be applied will now be described.

Figure 27:
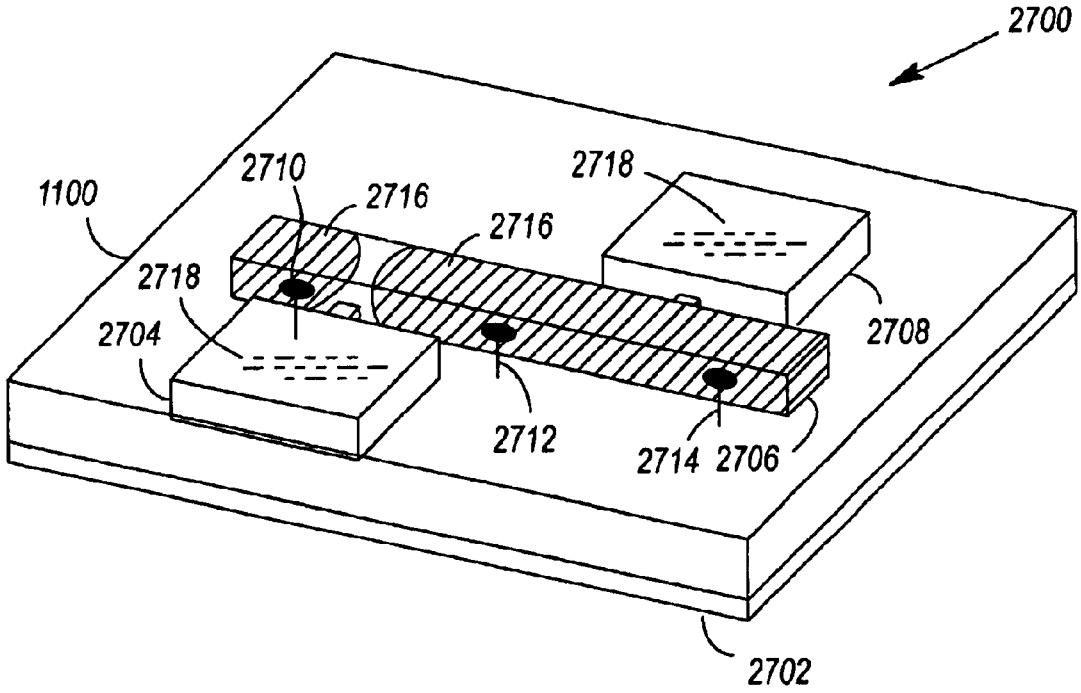
FIG. 27 illustrates a first exemplary embodiment of a switch.

FIG. 27 illustrates a first exemplary embodiment of a switch 2700. The switch 2700 comprises a channel plate 1100 defining at least a portion of a number of cavities 2704, 2706, 2708. The remaining portions of the cavities 2704–2708, if any, may be defined by a substrate 2702 to which the channel plate 1100 is sealed. Exposed within one or more of the cavities are a plurality of electrodes 2710, 2712, 2714. A switching fluid 2716 (e.g., a conductive liquid metal such as mercury) held within one or more of the cavities serves to open and close at least a pair of the plurality of electrodes 2710–2714 in response to forces that are applied to the switching fluid 2716. An actuating fluid 2718 (e.g., an inert gas or liquid) held within one or more of the cavities serves to apply the forces to the switching fluid 2716.

In one embodiment of the switch 2700, the forces applied to the switching fluid 2716 result from pressure changes in the actuating fluid 2718. The pressure changes in the actuating fluid 2718 impart pressure changes to the switching fluid 2716, and thereby cause the switching fluid 2716 to change form, move, part, etc. In FIG. 27, the pressure of the actuating fluid 2718 held in cavity 2704 applies a force to part the switching fluid 2716 as illustrated. In this state, the rightmost pair of electrodes 2712, 2714 of the switch 2700 are coupled to one another. If the pressure of the actuating fluid 2718 held in cavity 2704 is relieved, and the pressure of the actuating fluid 2718 held in cavity 2708 is increased, the switching fluid 2716 can be forced to part and merge so that electrodes 2712 and 2714 are decoupled and electrodes 2710 and 2712 are coupled.

By way of example, pressure changes in the actuating fluid 2718 may be achieved by means of heating the actuating fluid 2718, or by means of piezoelectric pumping. The former is described in U.S. Pat. No. 6,323,447 of Kondoh et al. entitled "Electrical Contact Breaker Switch, Integrated Electrical Contact Breaker Switch, and Electrical Contact Switching Method". The latter is described in U.S. patent application Ser. No. 10/137,691 of Marvin Glenn Wong filed May 2, 2002 and entitled "A Piezoelectrically Actuated Liquid Metal Switch". Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity. In such an arrangement, the channel plate for the switch could be constructed similarly to the channel plate 1100 disclosed herein.

The channel plate 1100 of the switch 2700 may have a plurality of channels 1102–1110 formed therein, as illustrated in FIGS. 11 & 12. In one embodiment of the switch 2700, the first channel 1104 in the channel plate 1100 defines at least a portion of the one or more cavities 2706 that hold the switching fluid 2716. By way of example, this switching fluid channel 1104 may have a width of about 200 microns, a length of about 2600 microns, and a depth of about 200 microns.

A second channel or channels 1102, 1106 may be formed in the channel plate 1100 so as to define at least a portion of the one or more cavities 2704, 2708 that hold the actuating fluid 2718. By way of example, these actuating fluid channels 1102, 1106 may each have a width of about 350 microns, a length of about 1400 microns, and a depth of about 300 microns.

A third channel or channels 1108, 1110 may be formed in the channel plate 1100 so as to define at least a portion of one or more cavities that connect the cavities 2704–2708 holding the switching and actuating fluids 2716, 2718. By way of example, the channels 1108, 1110 that connect the actuating fluid channels 1102, 1106 to the switching fluid channel 1104 may each have a width of about 100 microns, a length of about 600 microns, and a depth of about 130 microns.

Figure 14:
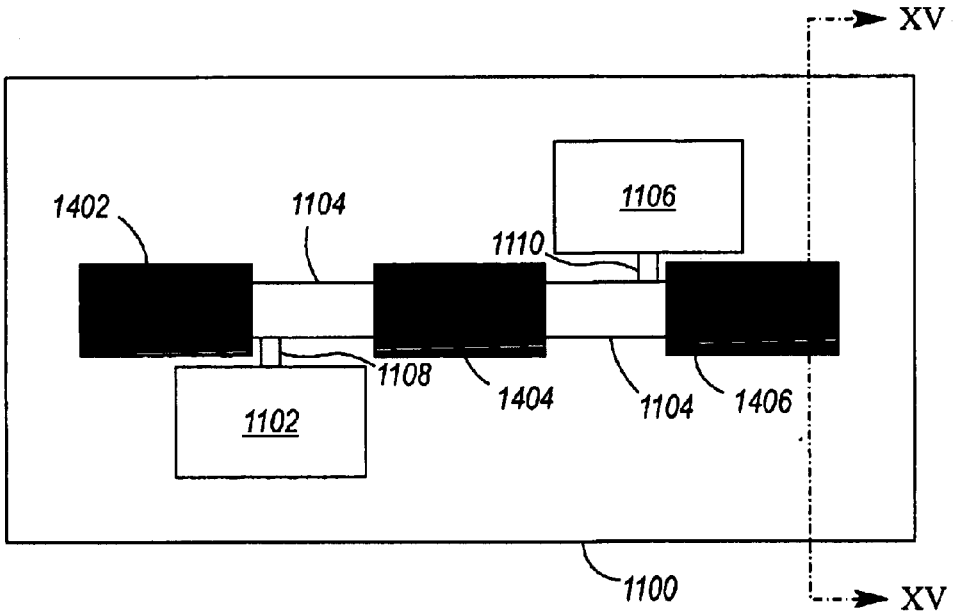
FIG. 14 illustrates the deposition of seal belts on the FIG. 11 channel plate.
Figure 15:
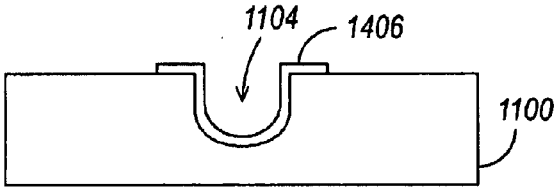
FIG. 15 illustrates a cross-section of the channel plate shown in FIG. 14.
Figure 28:
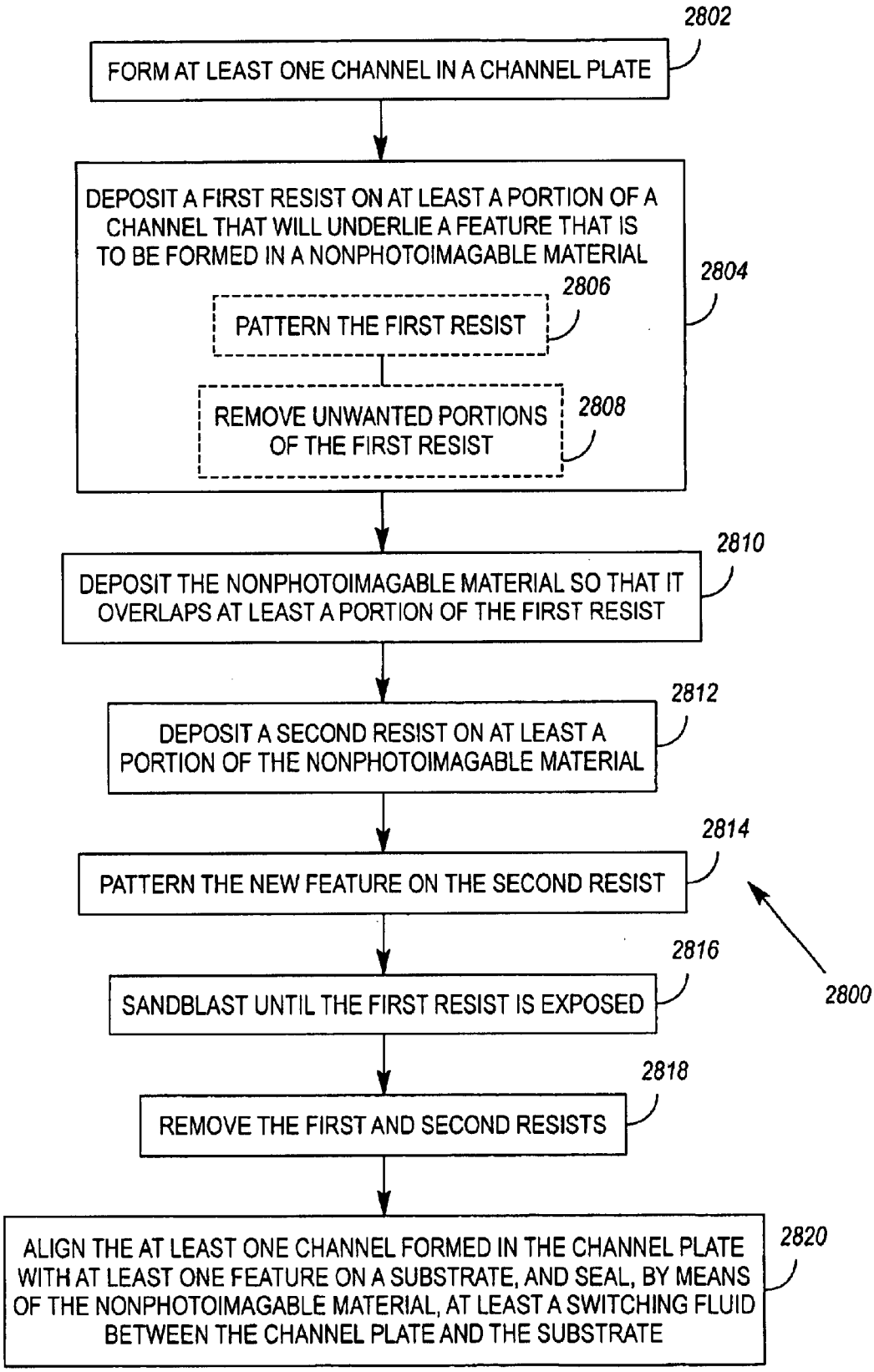
FIG. 28 illustrates a method for producing the switch shown in FIG. 27.

An exemplary method 2800 for producing the switch 2700 illustrated in FIG. 27 is illustrated in FIG. 28. The method 2800 commences with the formation 2802 of at least one channel 1102–1110 in a channel plate 1100. Depending on the composition of the channel plate 1100, as well as the channel tolerances desired, channels can be machined, injection molded, press molded, slump molded, etched, laser cut, ultrasonically milled, laminated, stamped or otherwise formed in the channel plate 1100. Thereafter, a first resist 1600 (FIG. 16) is deposited 2804 on one or more of the channels 1102–1110. It should be noted that the channels 1102–1110 may be empty as shown in FIGS. 11 & 12, lined as shown in FIGS. 14 & 15, or otherwise configured. The next several steps 2806–2818 of method 2800 correspond to similar steps 1304–1316 of method 1300. The reader is therefore referred back to the previous description of method 1300 (FIG. 13). Finally, the channels 1102–1110 formed in the channel plate 1100 are aligned with at least one feature on a substrate 2702, and at least a switching fluid 2716 is sealed 2820 between the channel plate 1100 and the substrate 2702, by means of the nonphotoimagable material 1800. As taught in FIG. 27, an actuating fluid 2718 may also be sealed between the channel plate 1100 and substrate 2702.

The material 1800 deposited on the channel plate 1100 may be, for example, an adhesive or gasket material. One suitable adhesive is Cytop™ (manufactured by Asahi Glass Co., Ltd. of Tokyo, Japan). Cytop™ comes with two different adhesion promoter packages, depending on the application. When a channel plate 1100 has an inorganic composition, Cytop™'s inorganic adhesion promoters should be used and the first resist 1600 deposited on a channel plate should be chemically dissimilar to the Cytop™ and the channel plate 1100 so that removal of the resist 1600 will not disturb the Cytop™ or the channel plate 1100. Similarly, when a channel plate 1100 has an organic composition, Cytop™'s organic adhesion promoters should be used, and the first resist deposited on a channel plate 1100 should be chemically dissimilar to the Cytop™ and the channel plate 1100 so that removal of the resist 1600 will not disturb the Cytop™ or channel plate 1100.

Optionally, and as illustrated in FIGS. 14 & 15, portions of a channel plate 1100 may be metallized (e.g., via sputtering or evaporating through a shadow mask, or via etching through a photoresist) for the purpose of creating "seal belts" 1402, 1404,1406. The creation of seal belts 1402–1406 within a switching fluid channel 1104 provides additional surface areas to which a switching fluid may wet. This not only helps in latching the various states that a switching fluid can assume, but also helps to create a sealed chamber from which the switching fluid cannot escape, and within which the switching fluid may be more easily pumped (i.e., during switch state changes).

Additional details concerning the construction and operation of a switch such as that which is illustrated in FIG. 27 may be found in the afore-mentioned patent of Kondoh et al. and patent application of Marvin Wong.

Figure 29:
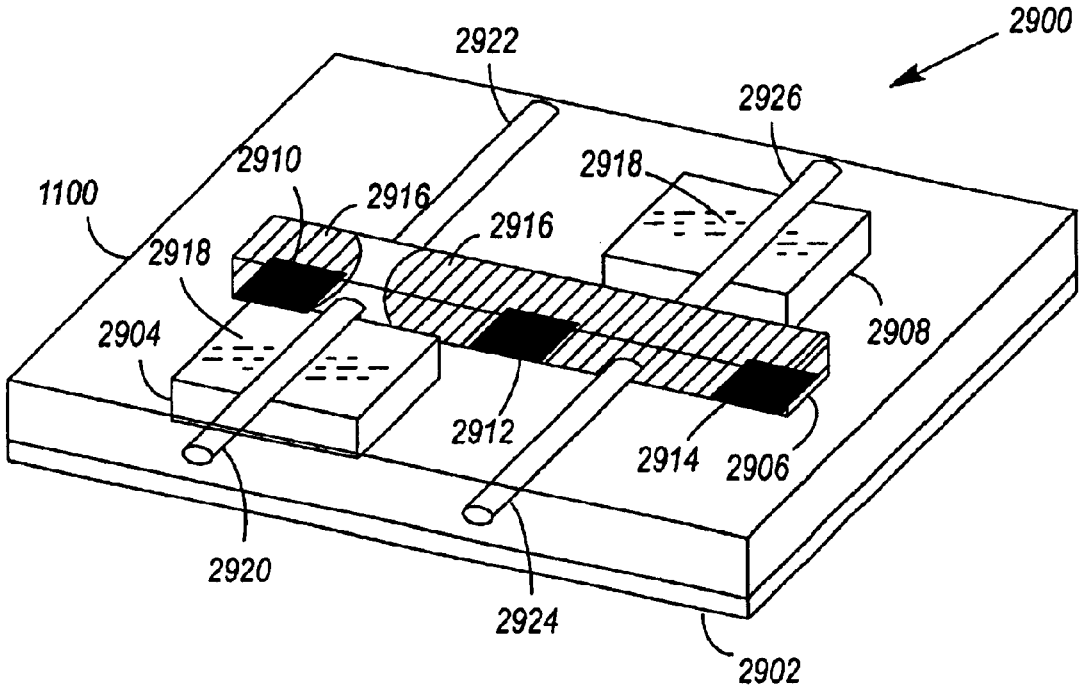
FIG. 29 illustrates a second exemplary embodiment of a switch.

FIG. 29 illustrates a second exemplary embodiment of a switch 2900. The switch 2900 comprises a channel plate 1100 defining at least a portion of a number of cavities 2904, 2906, 2908. The remaining portions of the cavities 2904–2908, if any, may be defined by a substrate 2902 to which the channel plate 1100 is sealed. Exposed within one or more of the cavities are a plurality of wettable pads 2910–2914. A switching fluid 2916 (e.g., a liquid metal such as mercury) is wettable to the pads 2910–2914 and is held within one or more of the cavities. The switching fluid 2916 serves to open and block light paths 2920/2922, 2924/2926 through one or more of the cavities, in response to forces that are applied to the switching fluid 2916. By way of example, the light paths may be defined by waveguides 2920–2926 that are aligned with translucent windows in the cavity 2906 holding the switching fluid. Blocking of the light paths 2920/2922, 2924/2926 may be achieved by virtue of the switching fluid 2916 being opaque. An actuating fluid 2918 (e.g., an inert gas or liquid) held within one or more of the cavities serves to apply the forces to the switching fluid 2916.

Forces may be applied to the switching and actuating fluids 2916, 2918 in the same manner that they are applied to the switching and actuating fluids 2916, 2918 in FIG. 27.

The channel plate 1100 of the switch 2900 may have a plurality of channels 1102–1110 formed therein, as illustrated in FIGS. 11 & 12. In one embodiment of the switch 2900, the first channel 1104 in the channel plate 1100 defines at least a portion of the one or more cavities 2906 that hold the switching fluid 2916.

A second channel or channels 1102, 1106 may be formed in the channel plate 1100 so as to define at least a portion of the one or more cavities 2904, 2908 that hold the actuating fluid 2918.

A third channel or channels 1108, 1110 may be formed in the channel plate 1100 so as to define at least a portion of one or more cavities that connect the cavities 2904–2908 holding the switching and actuating fluids 2916, 2918.

Additional details concerning the construction and operation of a switch such as that which is illustrated in FIG. 29 may be found in the afore-mentioned patent of Kondoh et al. and patent application of Marvin Wong. Furthermore, an adhesive or gasket layer, as well as seal belts, may be applied to the switch's channel plate 1100 as described supra, and as shown in FIGS. 14–25.

The use of channel plates is not limited to the switches 2700, 2900 disclosed in FIGS. 27 & 29 and may be undertaken with other forms of switches that comprise, for example, 1) a channel plate defining at least a portion of a number of cavities, a first cavity of which is defined by an ultrasonically milled channel in the channel plate, and 2) a switching fluid, held within one or more of the cavities, that is movable between at least first and second switch states in response to forces that are applied to the switching fluid. The patent of Kondoh, et al. and patent application of Marvin Glenn Wong that were previously incorporated by reference disclose liquid metal micro switches (LIMMS) that meet this description.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A switch, produced by:

a) forming at least one channel in a channel plate;

b) depositing a first resist on at least a portion of a channel that will underlie a feature that is to be formed in a nonphotoimagable material;

c) depositing the nonphotoimagable material so that it overlaps at least a portion of the first resist;

d) depositing a second resist on at least a portion of the nonphotoimagable material;

e) patterning the feature on the second resist;

f) sandblasting until the first resist is exposed;

g) removing the first and second resists; and h) aligning the at least one channel formed in the channel plate with at least one feature on a substrate, and sealing, by means of the nonphotoimagable material, at least a switching fluid between the channel plate and the substrate.

2. The switch of claim 1, wherein the nonphotoimagable material is an adhesive.

3. The switch of claim 2, wherein the adhesive is Cytop™.

4. The switch of claim 1, wherein the nonphotoimagable material is a gasket material.

5. The switch of claim 1, wherein a channel surface on which the first resist is deposited is metallic.

6. The switch of claim 1, wherein depositing the first resist comprises:

a) patterning the first resist; and b) removing unwanted portions of the first resist.

7. The switch of claim 1, wherein the first resist is deposited at a greater thickness than the nonphotoimagable material.

8. The switch of claim 1, wherein the first resist is deposited so that a width of the first resist is less than a width of a first channel on which it is deposited.

9. The switch of claim 1, wherein:

a) the at least one channel formed in the channel plate comprises a channel for holding the switching fluid, a channel for holding an actuating fluid, and a channel connecting the channel holding the actuating fluid to the channel holding the switching fluid; and b) the first resist is deposited on at least portions of each of these channels.

* * * * *